US005970958A

United States Patent [19]

DeLand et al.

[11] Patent Number: 5,970,958

[45] **Date of Patent: *Oct. 26, 1999**

[54] FUEL VAPOR PURGE CONTROL

[75] Inventors: Daniel L. DeLand, Davison; Charles A. Detweiler, Durand, both of Mich.

[73] Assignee: Eaton Corporation, Cleveland, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/949,106

[22] Filed: Oct. 10, 1997

[51] Int. Cl.[6] ..... F02M 33/02

[52] U.S. Cl. ..... 123/520; 123/458

[58] Field of Search ..... 123/520, 458, 123/521, 518, 516, 519, 198 D

[56] References Cited

U.S. PATENT DOCUMENTS

| | | | |
|---|---|---|---|
| 4,944,276 | 7/1990 | House | 123/520 |
| 5,050,568 | 9/1991 | Cook . | |
| 5,069,188 | 12/1991 | Cook | 123/520 |
| 5,083,546 | 1/1992 | Detweiler et al. . | |
| 5,115,785 | 5/1992 | Cook | 123/520 |
| 5,277,167 | 1/1994 | DeLand et al. . | |
| 5,284,121 | 2/1994 | Abe | 123/520 |
| 5,394,900 | 3/1995 | Okuyama | 123/463 |
| 5,413,082 | 5/1995 | Cook | 123/520 |
| 5,509,395 | 4/1996 | Cook | 123/520 |
| 5,551,406 | 9/1996 | Everingham | 123/520 |
| 5,657,962 | 8/1997 | Neron | 123/520 |

OTHER PUBLICATIONS

Herbert C. Roters, "Electromagnetic Devices", First Edition, 1941, pp. 232–237.

*Primary Examiner*—Carl S. Miller
*Attorney, Agent, or Firm*—Roger A. Johnston

[57] ABSTRACT

A variable area valve and pressure regulator for providing fuel vapor purge control in an evaporative emission control system of an automotive vehicle. A solenoid valve assembly selectively controls fluid communication between a fuel vapor source and an intake manifold by varying the area of an orifice associated with the solenoid valve assembly. A pressure regulator assembly is responsive to pressure differentials between an inlet cavity and an outlet cavity to further control the flow through the purge regulator. In operation, the purge regulator assembly is operable to generate nonlinear output flow characteristics which are independent of changes in the intake manifold vacuum, as well as the inlet pressure, and which further provides the desired nonlinear response.

26 Claims, 4 Drawing Sheets

FUEL VAPOR PURGE CONTROL

BACKGROUND OF THE INVENTION

The present invention relates generally to fuel vapor purge control for automotive vehicles equipped with computer control evaporative emission systems and more particularly to an electronically controlled variable area purge regulator.

Virtually all new automotive vehicles manufactured in the United States are equipped with emission control systems that are operable for limiting the emission of hydrocarbons into the atmosphere. One aspect of these emission control systems typically involves an evaporative emission control system which traps fuel vapors emitted from the fuel tank in a carbon-filled canister. The evaporative emission control system is periodically purged by drawing the fuel vapors from the canister into the engine intake system. In this manner, fuel vapors from the fuel tank are delivered to the engine for subsequent combustion.

Conventional evaporative emission control systems are equipped with a fixed area purge valve for regulating the flow rate of fuel vapors introduced into the intake system in response to the pressure difference between the intake manifold and atmosphere. These purge valves utilize a pulse width modulated (PWM) solenoid valve which is responsive to a duty cycle control signal from an engine controller unit (ECU) for selectively establishing and terminating communication between the canister and the intake system. However, these purge valves provide uneven flow characteristics, particularly at low engine speeds, and also do not provide consistent flow control independent of variations in manifold vacuum and inlet pressure.

More recent developments in this area include a vapor management valve which uses a diaphragm vacuum regulator in combination with an electric vacuum regulator (EVR) valve that regulates a vacuum signal in accordance with the current signal supplied thereto by the ECU. In operation, the vapor management valve is able to generate substantially linear output flow characteristics between two calibration points as a function of the solenoid current in a manner that is independent of changes in manifold vacuum of the engine intake system. U.S. Pat. No. 5,277,167, which is commonly owned by the assignee of the present invention and expressly incorporated by reference herein, discloses a vapor management valve which represents a significant improvement over the conventional PWM solenoid valves.

While the vapor management valve provides an advancement over a wide range of operating conditions, in this technology continuous improvements have been sought particularly with respect to extreme operating conditions. More specifically, the vapor management valve, which is referenced to atmospheric pressure, is designed to withstand relatively high canister pressures without leaking when the engine is off. However, the vacuum generated by the EVR may bias the diaphragm to a near open condition such that relatively low canister pressures (cracking pressure) can possibly open the valve and cause uncommanded purge flow. The vapor management valve also requires a continuous flow of air through the EVR into the intake manifold to operate. Accordingly, certain engine operating conditions, particularly in low friction engines having several devices that operate on engine vacuum, can result in a cumulative bleed flow which can exceed the desired idle air flow requirements of the engine resulting in excessive and/or fluctuating engine RPM. Likewise, the flow of air into the EVR can be restricted when the intake air filter of the vapor management valve becomes clogged, for example with snow, dust or dirt, or alternately when water is ingested therethrough. If the flow of air is sufficiently restricted, the vapor management valve will not perform as desired.

In view of increasingly stringent emission regulations, the demands on evaporative emission control systems have increased dramatically. In particular, in order to satisfy current Environmental Protection Agency (EPA) emission requirements, the purge flow through the canister must be increased. To achieve this result within the EPA city test cycle, it is therefore necessary to provide purge flow at engine idle speeds. Moreover, purge flow control must also be accurately regulated across the entire engine operating range so as not to cause unacceptable exhaust emissions.

To provide such enhanced flow control, it is desirable to have the output flow characteristics of the purge valve be continuous and proportional to the duty cycle of the electric control signal applied to the valve, even at low engine speeds, and yet be independent of variations to the inlet pressure and outlet manifold vacuum applied across the valve. Accordingly, the output flow of the valve should be substantially continuous at a given duty cycle control signal and be controllable in response to regulated changes in the duty cycle regardless of these pressure variations. Moreover, it is also desirable that the output flow of the purge regulator vary nonlinearly over the duty cycle range.

While the above-described flow regulators have been generally successful in providing substantially linear output flow between a given range of duty cycle, they have been unable to achieve the desirable non-linear output flow characteristics of the above-noted performance specifications. Accordingly, there is a continuing need to develop alternatives which meet these performance specifications and which can be manufactured and calibrated in a more efficient and cost effective manner.

SUMMARY OF THE INVENTION

It is a primary object of the present invention to overcome the disadvantages of the prior art and provide an electronically controlled variable area purge valve and pressure regulator that is less costly to manufacture and which minimizes the effects of inlet pressure and manifold vacuum on the performance of the purge regulator. As a related object, the variable area purge valve and pressure regulator of the present invention combines a solenoid valve assembly and a pressure regulator assembly for generating an output flow characteristic that varies as a function of the duty cycle of the electronic control signal and which is independent of variations in the inlet pressure and manifold vacuum.

Another object of the present invention is to provide a variable area purge regulator which utilizes a pressure regulator assembly to maintain a substantially constant pressure differential across the variable area purge control valve during operation thereof. One side of the pressure regulator assembly is referenced to the canister or inlet side of the system so that inlet pressure in the system will tend to close the regulator more tightly.

A further object of the present invention is to provide a variable area purge valve and pressure regulator which is operative without a bleed flow existing therethrough while being capable of satisfying the desired performance specifications across the entire range of engine operating conditions and is not susceptible to adverse environmental conditions.

Additional objects and advantages will become apparent from a reading of the following detailed descriptions of the preferred embodiments taken in conjunction with the accompanying drawings and appended claims.

DESCRIPTION OF THE PREFERRED EMBODIMENT

In general, the present invention is directed to improvements in proportional valves of the type used in automotive vehicles for controlling the flow of fluid from a fluid source to a fluid sink. More particularly, a preferred embodiment of an electronically controlled variable area purge regulator is disclosed which is adapted for use in an evaporative emission control system for purging fuel vapors collected in a charcoal canister into the intake system of an internal combustion engine associated with the vehicle. However, it will be readily appreciated that the improved purge regulator of the present invention has utility in other flow controlling applications.

Figure 1:
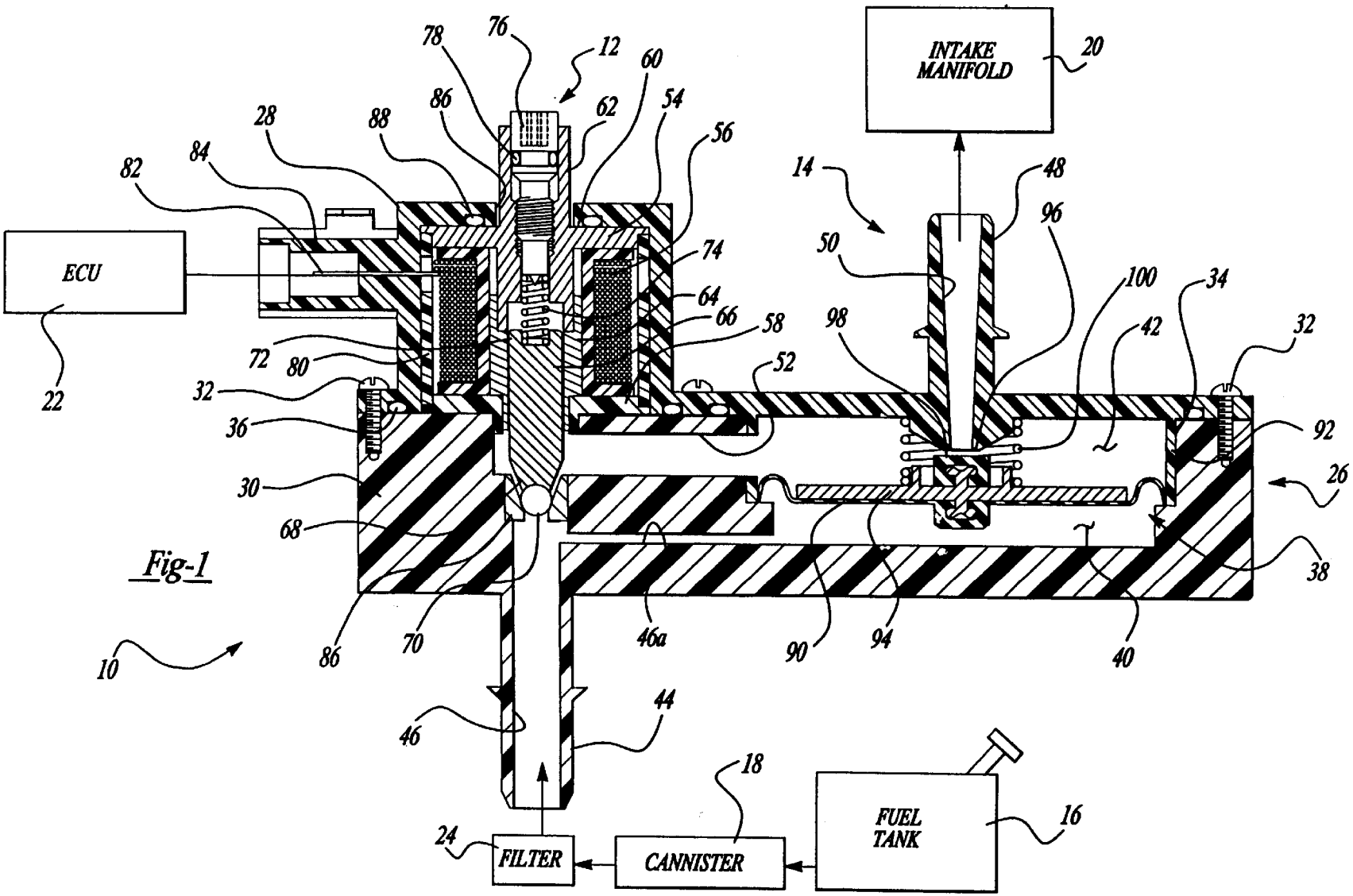
FIG. 1 is a sectional view of an electronically controlled variable area purge regulator shown schematically associated with an evaporative emission control system according to a first preferred embodiment of the present invention.

In the drawings, wherein for purposes of illustration is shown preferred embodiments of the present invention, electronically controlled variable area purge regulator 10, 110 is disclosed as having solenoid valve assembly 12, 112 and pressure regulator assembly 14, 114. For example, as illustrated in FIG. 1, variable area purge regulator 10 is of the type associated with a conventional evaporative emission control system for an automotive vehicle. More specifically, fuel vapors vented from fuel tank 16 are collected in charcoal canister 18 and are controllably purged by variable area purge regulator 10 into intake manifold 20 of an internal combustion engine in response to electrical control signals supplied to solenoid valve assembly 12 by engine controller unit (ECU) 22. Filter 24 may be optionally included in the above-described flow path between canister 18 and variable area purge regulator 10 to filter foreign material and charcoal particles which may be released from canister 18. As will be discussed in greater detail hereinafter, the structure of variable area purge regulator 10 provides a variable area orifice valve assembly which accurately regulates fuel vapor purge flow from canister 18 to intake manifold 20 independent of pressure differences between inlet pressure and manifold vacuum. The present invention can be simply and precisely calibrated to meet the desired output flow characteristics across the entire operating range of the engine. Furthermore, while pressure regulator assembly 14 and solenoid valve assembly 12 are shown assembled as a unitary component, it is to be understood that these assemblies could be separate components that are interconnected for communication therebetween in a known manner.

With further reference to FIG. 1, purge regulator 10 includes plastic control valve housing 26 having cover 28 secured to body 30 by threaded fasteners 32. A pair of o-rings 34, 36 are disposed between cover 28 and body 30 to hermetically seal purge regulator 10. Chamber 38 is formed within body 30 and is enclosed by cover 28. Pressure regulator assembly 14 is disposed within and partitions chamber 38 to define inlet cavity 40 and outlet cavity 42.

Nippled inlet connector 44 extending from body 30 has inlet passageway 46 formed therein to provide communication from filter 24 to inlet cavity 40 via inlet passageway 46*a*. Similarly, nippled outlet connector 48 which extends from cover 28 has outlet passageway 50 formed therein for providing communication between outlet cavity 42 and intake manifold 20. As presently preferred, the cross-sectional area of outlet passageway 50 increases from outlet cavity 42 toward intake manifold 20 to provide a smooth transition therebetween. Solenoid valve assembly 12 selectively controls or modulates fluid communication between inlet passageway 46 and outlet passageway 50 through bypass passageway 52. The inlet side of pressure regulator assembly 14 is referenced to the inlet pressure in fuel tank 16. The outlet side of pressure regulator assembly 14 is referenced to the pressure downstream of valve assembly 14. In this manner, solenoid valve assembly 12 and pressure regulator assembly 14 are able to maintain a substantially constant pressure differential regardless of fluctuations in the input pressure from fuel tank 16 or outlet pressure from intake manifold 20.

Figure 2:
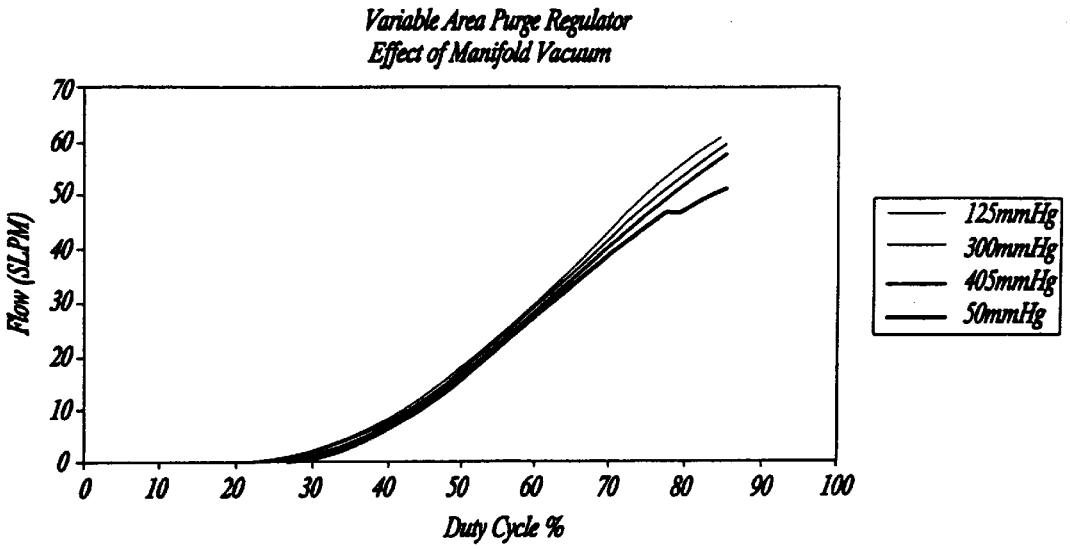
FIG. 2 is an exemplary plot which graphically illustrates the output flow rate of the variable area purge regulator as a function of percentage duty cycle for a plurality of intake manifold vacuum values.

With reference to FIG. 2, it can be seen that purge regulator 10 provides a nonlinear relationship between the output flow and the duty cycle. More specifically, purge regulator 10 maintains a substantially linear relationship between the fuel vapor flow and percent duty cycle irrespective of intake manifold vacuum conditions above the fifty percent (50%) duty cycle point. Moreover, purge regulator 10 provides a smooth non-linear relationship between the fuel vapor flow and percent duty cycle at the "start-toopen" portion of the duty cycle, i.e., zero percent (0%) to fifty percent (50%) irrespective of intake manifold vacuum. The response of purge regulator 10 is substantially unchanged by the effects of manifold vacuum as illustrated by response curve 202 at 125 mm Hg, response curve 204 at 300 mm Hg, response curve 206 at 405 mm Hg and response curve 208 at 50 mm Hg, the previous pressures being indicated in gage pressure.

Figure 3:
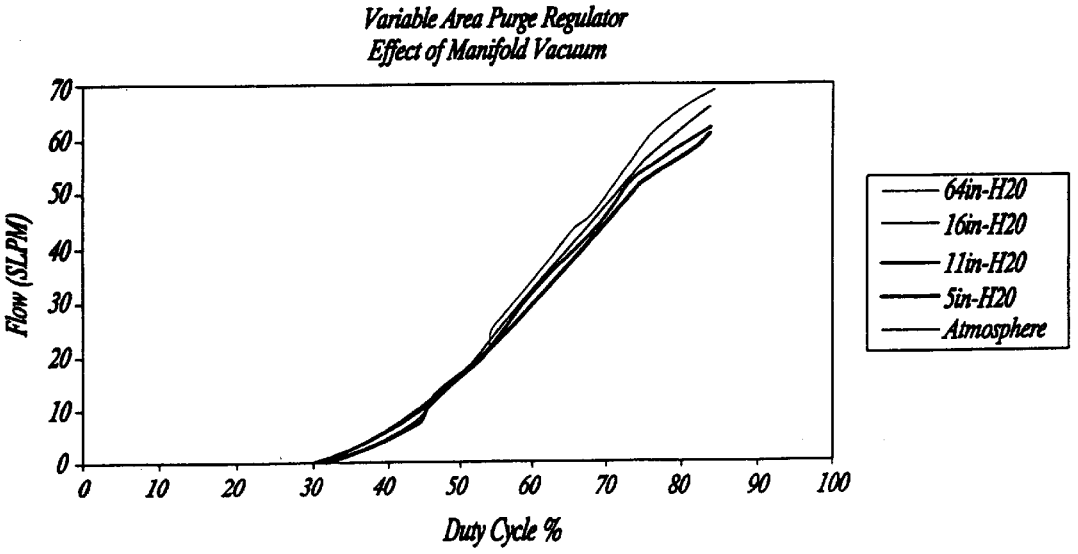
FIG. 3 is an exemplary plot which graphically illustrates the output flow rate of the variable area purge regulator as a function of percentage duty cycle for a plurality of inlet pressures of the fuel vapor canister.

With reference to FIG. 3, purge regulator 10 maintains a substantially linear relationship between the fuel vapor flow and percent duty cycle irrespective of inlet pressures above the fifty percent (50%) duty cycle point. Moreover, purge regulator 10 provides a smooth non-linear relationship between the fuel vapor flow and percent duty cycle at the "start-to-open" portion of the duty cycle irrespective of inlet pressures. The response of purge regulator 10 is substantially unchanged by the effects of inlet pressure as illustrated by response curve 210 at 64 in-$H_2O$, response curve 212 at 16 in-$H_2O$, response curve 214 at 11 in-$H_2O$, response curve 216 at 5 in-$H_2O$ and response curve 218 at atmospheric pressure or 0 in-$H_2O$, the previous pressures being indicated in gage pressure.

Referring again to FIG. 1, purge regulator 10 further includes solenoid valve assembly 12 disposed within cover 28. Solenoid valve assembly 12 includes bobbin 54 formed of a nonmagnetic material having a wire coil 56 wrapped therearound to form a coil assembly having a bore formed therethrough along a central longitudinal axis. Flux collector 58 is positioned on a lower adjacent surface of bobbin 54 and pole piece 60 is positioned on an upper adjacent surface of bobbin 54. Pole piece 60 further includes a tubular portion 62 extending longitudinally into the bore formed by bobbin 54. Similarly, armature bushing 64 is longitudinally disposed within bobbin 54 and is captured between tubular portion 62 and flux collector 58 for retaining the appropriate orientation thereof. Magnetic armature 66 is slidably disposed within armature bushing 64 for reciprocating movement along the central longitudinal axis of solenoid valve assembly 12. A lower end 68 of armature 66 tapers to a spherically concaved tip which receives valve ball 70 therein. In addition, a bypass valve seat 86 is retained in a portion of passageway 52 which receives ball 70 therein. In this way, lower end 68, valve ball 70 and valve seat 86 are configured to provide means for selectively controlling fluid communication between inlet passageway 46 and outlet passageway 50 through a smoothly transitioning flow path to pressure regulator assembly 14. While the geometry of lower end 68 of armature 66 as described and illustrated herein are presently preferred, lower end 68 of armature 66 could be adapted to include an alternate geometry, such as a rounded or spherically convex tip, a flat tip or a conical tip, and may alternatively eliminate valve ball 70. Likewise, the outer surface of upper end 72 of armature 66 is tapered as denoted by reference numeral 73 to provide an approximately linear force-distance curve over the range of reciprocal movement of armature 66 within the electromagnetic coil assembly. Second end 72 of armature 66 has a blind bore formed therein for receiving spring 74 which biases solenoid valve assembly toward a closed position.

Tubular portion 62 of pole piece 60 is internally threaded for receiving calibration screw 76 which engages an end of spring 74 opposite armature 66 and provides means for adjusting a preload in spring 74 for biasing armature 66. O-ring 78 is disposed around an upper portion of calibration screw 76 to provide sealing engagement with tubular portion 62 of pole piece 60 to maintain the hermetic seal of purge regulator 10. Solenoid housing 80 encloses the components of solenoid assembly 12 between flux collector 58 and pole piece 60 to provide an encapsulated solenoid assembly. Terminal blade 82 is electrically connected to the coil assembly and extends through solenoid housing 80 and connector 84 which extends from cover 28. Terminal blade 82 and connector 84 provide an electrical connection between ECU 22 and solenoid valve assembly 12. Solenoid valve assembly 12 is captured between cover 28 and body 30 such that tubular portion 62 of pole piece 60 extends through aperture 87 formed in cover 28. O-ring 88 circumscribes aperture 87 and is disposed between an inner surface of cover 28 and pole piece 60 to hermetically seal purge regulator 10.

Pressure regulator assembly 14 of purge regulator 10 includes diaphragm 90 operatively disposed within and partitioning chamber 38. More specifically, annular flange 92 extends downwardly from cover 28 and captures a peripheral portion of diaphragm 90 on a shoulder portion formed in body 30. Piston 94 is disposed on a top surface of diaphragm 90 within outlet cavity 42 for providing rigidity to diaphragm 90. Outlet valve seat 96 is formed at an end of outlet passageway 50 within outlet cavity 42. Outlet valve seal 98 is formed on piston 94 and is engageable with outlet valve seat 96 to selectively control fluid communication between outlet cavity 42 and outlet passageway 50.

Spring 100 is supported and operatively disposed between cover 28 and piston 94 to provide a preload for biasing outlet valve seal 98 away from outlet valve seat 96. As illustrated, pressure regulator assembly 14 is assembled in a net build manner whereby the part to part variation between control valve body 26 and piston 94 are determined by the installed load of spring 100. Alternatively, a portion of cover 28 adjacent nippled outlet connector 48 which acts as the upper spring seat could be threadedly coupled to the remainder of cover 28 such that the upper spring seat is axially adjustable along the longitudinal axis of outlet passageway 50 to calibrate the preload in spring 100. As a second alternative, an upper spring seat which is axially adjustable along the longitudinal axis of outlet passageway 50 could be employed to calibrate the preload in spring 100.

Fuel vapor purge control in accordance with the present invention will now be described. Prior to start-up, variable area purge regulator 10 is in a static condition such that the pressure in outlet cavity 42 is approximately atmospheric and the pressure in inlet cavity 40 is approximately atmospheric or slightly greater than atmospheric due to residual vapor pressure within fuel tank 16. If the pressure differential across pressure regulator assembly 14 exceeds the regulating pressure (50 mm Hg), pressure regulator assembly 14 urges valve seal 98 against valve seat 96, thereby terminating communication between outlet cavity 42 and outlet passageway 50. Otherwise pressure regulator assembly 14 remains open. Solenoid valve assembly 12 is positioned in a closed condition to selectively terminate communication between inlet passageway 46 and passageway 52.

Upon start up of the vehicle engine, a vacuum is generated within intake manifold 20 drawing from cavity 42 until the pressure differential is sufficient to compress spring 100 and seal valve seat 98. After certain diagnostic algorithms are executed, ECU 22 provides a current proportional to duty cycle for energizing electromagnetic coil 56 to appropriately position armature 66 along the central longitudinal axis of solenoid valve assembly 12, thereby selectively establishing and proportionally controlling fluid communication between inlet passageway 46 and passageway 52. Upon establishment of fluid communication between inlet passageway 46 and passageway 52, fuel vapors which have been collected in canister 18 are drawn through inlet passageway 46 and passageway 52 to pressurize outlet cavity 42. The flow of fuel vapors along this path decreases the pressure differential across pressure regulator assembly 14 causing valve seal 98 to move away from valve seal 96 such that a force balance between the pressure differential across pressure regulator assembly 14 and spring 100 controls the flow of fuel vapor so as to maintain a substantially constant pressure differential therebetween. Similarly, variations in the area of the orifice defined by valve seat 86 and valve ball 70 will affect the amount of fuel vapor transported through purge regulator 10. As the area of the orifice formed between valve seat 86 and valve ball 70 increases, the fuel vapor flow increases, thereby increasing the pressure in outlet cavity 42. As such, the pressure differential across pressure regulator assembly 14 is decreased causing diaphragm 90 to move upwardly away from outlet valve seat 96, thereby increasing the outlet flow of fuel vapor through outlet passageway 50 to maintain a substantially constant pressure differential across valve ball 70 and seat 86. In this manner fuel vapor flow is initiated by solenoid valve assembly 12 and controlled by pressure regulator assembly 14.

Since inlet cavity 40 of pressure regulator assembly 14 is referenced to the inlet pressure in fuel tank 16, purge regulator 10 operates substantially independent of fluctuations in inlet pressure from fuel tank 16. Furthermore, reference to the inlet pressure prevents pressure regulator 10 from blowing open under high fuel tank pressure conditions. Increased pressure in fuel tank 16 will close pressure regulator assembly 14. Moreover, the combination of solenoid valve assembly 12 and pressure regulator assembly 14 provides a more gradual flow curve over the lower duty cycle settings (e.g. thirty percent to fifty percent), while still maintaining maximum flow requirements. Accordingly, by purposefully inducing a non-linearity into the flow curve, a desirable control feature is achieved because it gives ECU 22 better ability to precisely control low purge flow rates at idle.

Figure 4:
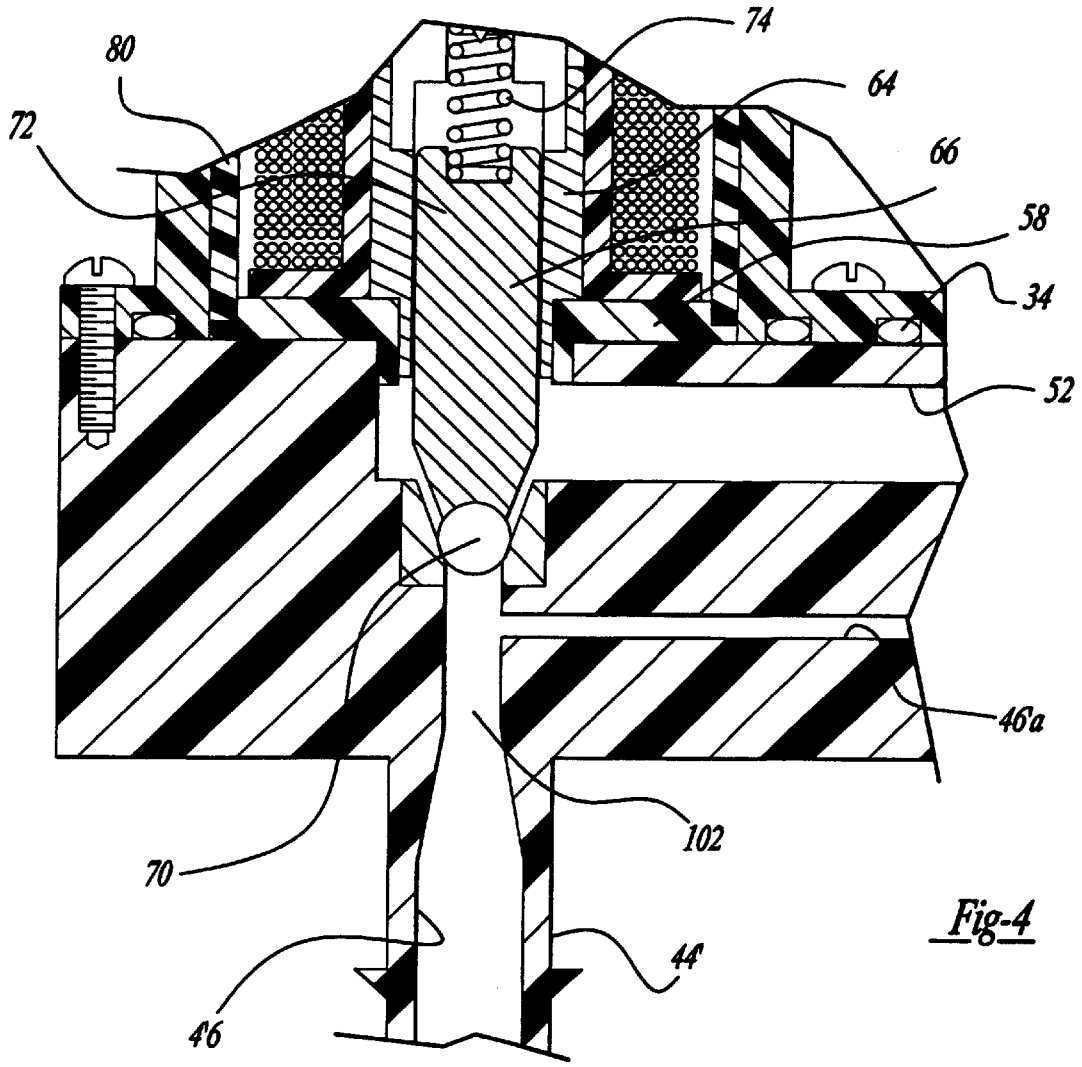
FIG. 4 is a partial sectional view illustrating certain modifications to the electronically controlled variable area purge regulator shown in FIG. 1.

Referring now to FIG. 4, a modification to the first preferred embodiment previously discussed with reference to FIG. 1 is shown. As such, identical components are identified with identical reference numerals utilized in FIG. 1, and modified components are identified by prime superscripts. More specifically, nippled inlet connector 44' extends downwardly from body 30' and has inlet passageway 46' formed therein. Venturi 102 is formed at an intermediate portion of inlet passageway 46' adjacent solenoid valve seat 86. Inlet passageway 46' tapers to a diameter approximately equal to the orifice at the bottom of tapered valve seat 86. Venturi 102 operates to locally increase the velocity of the flow through inlet passageway 46', thereby decreasing the pressure of the flow within inlet passageway 46'. Accordingly, venturi 102 decreases the pressure differential across pressure regulator assembly 14 during high flow conditions and in effect creating a positive feedback system whereby an increase in inlet pressure results in greater flow through purge regulator 10'. However, venturi 102 does not significantly alter the operation of purge regulator 10' during low flow conditions. Thus, venturi 102 provides a means for tuning purge regulator 10' to yield a more gradual slope at the start-to-open point, i.e. thirty percent to fifty percent (30%–50%) duty cycle, and increased flow rates at a duty cycle greater than fifty percent (50%).

Figure 5:
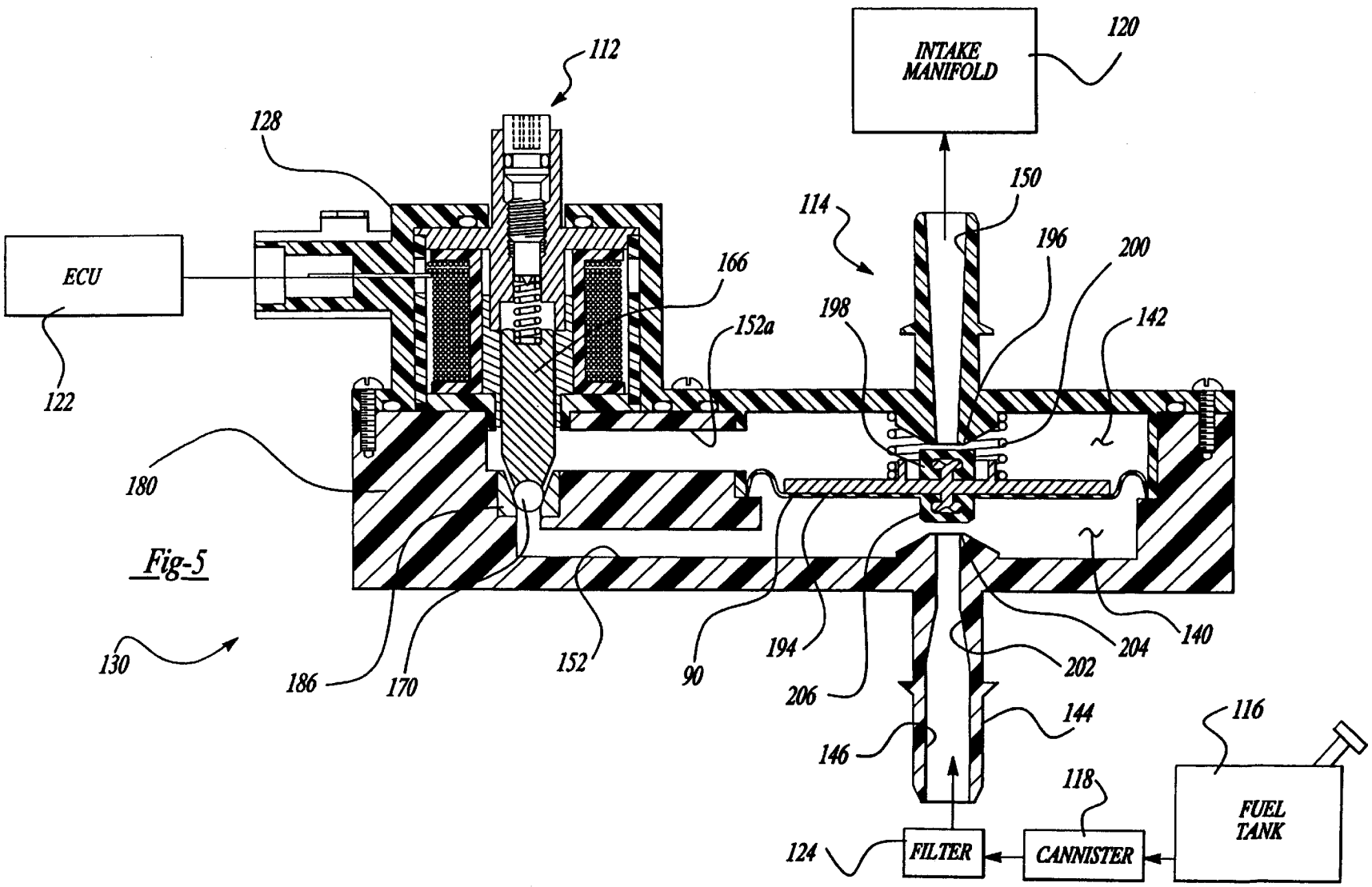
FIG. 5 is a sectional view of an electronically controlled variable area purge regulator shown schematically associated with an evaporative emission control system according to a second preferred embodiment of the present invention.

Referring now to FIG. 5, a second preferred embodiment of variable area purge regulator 110 according to the present invention is illustrated in which inlet passageway 146 is positioned directly adjacent pressure regulator assembly 114 for providing a positive shut-off regulator which terminates communication between inlet passageway 146 and inlet cavity 140 under certain conditions notably when the engine is off. Due to the similarities between the first preferred embodiment illustrated in FIGS. 1 and 4 and the second preferred embodiment illustrated in FIG. 5, like reference numerals incremented by a factor of one hundred (100) will be utilized to identify components which are similar therebetween.

Variable area purge regulator 110 includes solenoid valve assembly 112 and pressure regulator assembly 114. Fuel vapors vented from fuel tank 116 are collected in charcoal canister 118 and are controllably purged by variable area purge regulator 110 into intake manifold 120 of an internal combustion engine in response to electrical control signals supplied to solenoid valve assembly 112 by ECU 122. Filter 124 may be optionally included in the above-described flow path between canister 118 and variable area purge regulator 110.

Purge regulator 110 includes plastic control valve housing 126 having cover 128 secured to body 130 by threaded fasteners 132. Chamber 138 is formed within body 130 and enclosed by cover 128. Pressure regulator assembly 114 is disposed within and partitions chamber 138 to define inlet cavity 140 and outlet cavity 142. Control valve housing 126 further includes nippled inlet connector 144 which extends downwardly from body 130 has inlet passageway 146 formed therein. As presently preferred, inlet 202 formed in inlet passageway 146 is reduced to reduce the valve diameter and terminates at inlet cavity 140. Inlet valve seat 204 is formed at an end of inlet passageway 146 adjacent pressure regulator assembly 114. Inlet valve seal 206 is formed on diaphragm 190 and extends towards inlet valve seat 204. Similarly, outlet valve seal 198 extends upwardly from piston 194 and is engageable with outlet valve seat 196. In this manner, pressure regulator assembly 114 is responsive to the pressure differential between inlet cavity 140 and outlet cavity 142 to terminate communication between inlet passageway 146 and inlet cavity 140, or alternately terminate communication between outlet passageway 150 and outlet cavity 142.

Purge regulator 110 further includes passageway **152*a* to provide communication from inlet cavity 140 to outlet cavity 142 through passageway 152 via actuation of solenoid valve assembly 112. Solenoid valve assembly 112 includes magnetic armature 166 which is slidably disposed within armature bushing 164 for reciprocating movement along the central longitudinal axis of solenoid assembly 112. A first end 168 of armature 166 is tapered and terminates at a spherical tip which receives valve ball 170 therein. Solenoid valve assembly 112 further includes tapered bypass valve seat 186 disposed within passageway 152*a* which cooperates with valve ball 170 and armature 166 for selectively controlling and modulating fluid communication between passageway 152 and 152*a***.

One skilled in the art will readily appreciate that purge regulator 110 operates in substantially the same manner as purge regulator 10 described above. In addition, due to the location of inlet passageway 146 with respect to inlet valve seal 206, purge regulator 110 is capable of terminating communication between inlet passageway 146 and inlet cavity 140. More specifically, when the pressure differential between inlet cavity 140 and outlet cavity 142 falls below a given level, spring 200 urges inlet valve seal 206 against inlet valve seat 204, thereby terminating communication between inlet passageway 146 and inlet cavity 140. This mechanism provides an effective means of positive shut off of all flow from canister 118 when the engine is not running and manifold vacuum drops to zero.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A regulator valve for controlling the purging of fuel vapors collected in a canister of an evaporative emission control system into an intake system of an internal combustion engine, comprising:

a housing having a chamber formed therein, an inlet port providing fluid communication from said canister to said chamber, and an outlet port providing fluid communication from said chamber to the intake system of the internal combustion engine;

a pressure regulator assembly comprising a diaphragm disposed within and partitioning said chamber into an inlet cavity and an outlet cavity isolated from said inlet cavity by said diaphragm, said inlet cavity being in communication with said inlet port, and a first valve member operatively connected to said diaphragm and disposed between said outlet cavity and said outlet port for controlling fluid flow from the outlet cavity to the outlet port; and a solenoid valve assembly comprising an armature, an electromagnetic coil and a second valve member operatively connected to said armature and disposed between said inlet port and said outlet cavity for controlling all fluid flow from said inlet port to said outlet cavity in accordance with an electrical control signal supplied to said electromagnetic coil.

2. The regulator valve of claim 1 wherein the inlet cavity of said chamber is sealed relative to atmosphere.

3. The regulator valve of claim 2 wherein said solenoid valve assembly is sealed relative to atmosphere.

4. The regulator valve of claim 3 further including first biasing means for biasing said first valve member toward an open position permitting fluid flow from said outlet cavity to the outlet port.

5. The regulator valve of claim 4 further including third valve means operatively connected to the movable wall and disposed between the inlet cavity and the inlet port for controlling fluid flow from the inlet port into the inlet cavity.

6. The regulator valve of claim 5 wherein said first biasing means also serves to bias said third valve member toward a closed position blocking fluid flow from said inlet port into said inlet cavity.

7. The regulator valve of claim 6 wherein said inlet port has a venturi formed therein.

8. The regulator valve of claim 3 wherein said armature comprises a cylindrical member having a conically or spherically shaped first end that is operatively associated with a valve seat disposed in a passageway between said inlet port and said outlet cavity such that the fluid flow rate through said passageway is controlled by the position of said armature relative to said valve seat which is in turn controlled by the magnitude of said electrical control signal supplied to said electromagnetic coil.

9. The regulator valve of claim 8 wherein said armature has a tapered portion along a second end opposite said first end for modifying the effect thereon of a magnetic flux generated by said electromagnetic coil.

10. The regulator valve of claim 8 wherein said solenoid valve assembly further comprises a spring for biasing said second valve member toward said valve seats.

11. The regulator valve of claim 8 wherein said solenoid valve assembly further comprises calibration means for calibrating the fluid flow characteristics of said solenoid valve assembly.

12. The regulator valve of claim 1 wherein purge flow from the inlet port to the outlet port is serially through said second and first valve members.

13. A regulator valve for controlling the flow of fluid from a fluid source to a fluid sink comprising:

(a) a housing having a chamber formed therein;

(b) a pressure regulator assembly including a moveable wall disposed within and partitioning said chamber to defining on opposite sides thereof a fluid pressure inlet cavity and a fluid pressure outlet cavity isolated from said inlet cavity by said wall, said housing having an inlet port for connection to said source and communicating with said inlet cavity; and an outlet port for connection to said sink and communicating with said outlet cavity;

(c) a first valve member operatively connected to the moveable wall and moveable thereby for controlling fluid flow from the outlet cavity to the outlet port; and, (d) an electrically operated valve assembly including a second valve member disposed between the inlet port and the outlet cavity for controlling all fluid flow from the inlet port to the outlet cavity.

14. The regulator defined in claim 13, wherein said housing includes a passage continuously communicating said inlet port with said inlet chamber.

15. The regulator valve of claim 13 further including first biasing means for biasing said first valve member toward an open position permitting fluid flow from said outlet cavity to the outlet port.

16. The regulator valve of claim 15 further including third valve means operatively connected to the movable wall and disposed between the inlet cavity and the inlet port for controlling fluid flow from the inlet port into the inlet cavity.

17. The regulator valve of claim 16 wherein said first biasing means also serves to bias said third valve member toward a closed position blocking fluid flow from said inlet port into said inlet cavity.

18. The regulator valve of claim 13 wherein said inlet port has a venturi formed therein.

19. The regulator valve of claim 13 wherein said solenoid valve assembly includes:

an armature;

a solenoid having an electromagnetic coil operable to control the position of said armature;

a second valve member operatively connected to a first end of said armature; and a valve seat disposed in a passageway between the inlet port and the outlet cavity, such that the amount of fluid flow through said passageway is selectively controlled by an electrical control signal supplied to said solenoid.

20. The regulator valve of claim 19 wherein said second valve member comprises a conical or spherical member formed on said first end of said armature and operatively associated with said valve seat to control the fluid flow rate through said passageway in accordance with the relative position of said second valve member to said valve seat.

21. The regulator valve of claim 20 wherein said armature comprises a cylindrical member having a tapered portion along a second end opposite said first end for modifying the effect thereon of a magnetic flux generated by said electromagnetic coil.

22. The regulator valve of claim 19 wherein said solenoid valve assembly further comprises a spring for biasing said second valve member toward said valve seat.

23. The regulator valve of claim 22 wherein said solenoid valve assembly further comprises calibration means for calibrating the fluid flow characteristics of said solenoid valve assembly.

24. The regulator valve of claim 13 wherein the inlet cavity of said chamber is sealed relative to atmosphere.

25. The regulator valve of claim 13 wherein said solenoid valve assembly is sealed relative to atmosphere.

26. The regulator valve of claim 13 wherein fluid flow from the inlet port to the outlet port is serially through said second and first valve members.

* * * * *